United States Patent [19]

Van Horne et al.

[11] Patent Number: 4,943,045

[45] Date of Patent: Jul. 24, 1990

[54] PRINTER SHEET FEED SYSTEM

[75] Inventors: Arthur C. Van Horne; Eldon P. Hoffman, both of Lake Oswego; Paul D. Bakke, Beaverton, all of Oreg.

[73] Assignee: Tektronix, Inc., Beaverton, Oreg.

[21] Appl. No.: 232,419

[22] Filed: Aug. 15, 1988

[51] Int. Cl.[5] ..... B65H 3/00

[52] U.S. Cl. ..... 271/277; 346/138; 400/618

[58] Field of Search ..... 271/277, 275, 3, 306, 271/314; 400/578, 600, 617, 618, 629, 632, 632.1, 642, 646, 647, 647.1, 662; 101/37, 40.1, 44, 53, 118, 232, 279, 408, 409, 410; 346/75, 138

[56] References Cited

U.S. PATENT DOCUMENTS

| | | | |
|---|---|---|---|
| 3,536,321 | 10/1970 | Straube | 271/277 |
| 4,517,575 | 5/1985 | Kakimoto et al. | 271/277 X |
| 4,729,557 | 3/1988 | Kiyohara | 271/314 X |
| 4,824,096 | 4/1989 | Fichter et al. | 271/277 |

OTHER PUBLICATIONS

"Field Service Manual–4693 Color Printer", Tektronix, Inc., vol. 1, pp. 2–11 to 2–15, Sep. 1988.

*Primary Examiner*—Joseph J. Rolla
*Assistant Examiner*—David H. Bollinger
*Attorney, Agent, or Firm*—Edward B. Anderson

[57] ABSTRACT

A print medium sheet feeding system for an ink jet printer having a print head with a planar array of jets is provided by clamping the leading edge of a paper after it is passed through a printing zone to a rotating assembly of parallel disks. The sheet is pulled through the printing zone by rotating the disk with the clamp being carried with the rotating drum. A platen may be provided which has a flat surface in the printing zone forming a tangent to the outer surface of the rotating disks. Alternatively, the platen may be removed and the sheet held in tension between the clamp and a nip region formed by a spring plate held against a restraining plate. In an alternative embodiment, the sheet is initially clamped against the drum by the combination of a lever arm which is selectively engageable with the drum for rotation therewith and an attached actuating arm having a plate which secures a sheet to the drum surface. The resulting clamp rotates with the drum until the sheet passes below idler rollers which are biased against the drum surface. These rollers then hold the sheet against the drum for motion of the sheet with the drum surface. The actuating arm is released from the drum after a sheet passes below the rollers, thereby allowing any sized sheet to be fed through the system.

7 Claims, 7 Drawing Sheets

PRINTER SHEET FEED SYSTEM

FIELD OF THE INVENTION

This invention relates to a print medium sheet feed system for a printer, and in particular, to such a system wherein a sheet on which an image is printed is transported through a printing zone in a controlled fashion.

BACKGROUND OF THE INVENTION

In a conventional printer used for printing computer or other data source output, a print medium, such as paper, whether in the form of cut sheets or fan fold, is moved from a paper supply past the area where the image is applied to the sheet, and into position to be picked up by the user. One widely used method for such a paper path employs a cylindrical typewriter-style platen which acts as both the prime mover for the paper and the paper support surface used during imaging. Such a system has a simple design, relatively few parts, and reliable operation. However, there are limitations in this type of system which make it inappropriate for use in a printer, such as one having an array of ink jet nozzles, for producing high resolution graphic images.

One limitation is the size of the margins on the print sheet. In a typical text printer, the leading edge of the sheet is fed around the platen until it is captured under several idler rollers which are spring loaded against the platen. The idler rollers keep the paper in contact with the platen so that when the platen rotates, the paper moves with it without slipping. The size of the print head is usually such that when the print head traverses back and forth to produce text, it travels quite close to the idler rollers. In this arrangement the head can be positioned close enough to the leading edge of the paper to produce suitable margins for a business letter. In a graphics printer, a much smaller margin is generally required. Additionally, the size of an ink jet head may be much larger than a print head used for text. When the idler rollers are positioned so that they clear this head, the resulting margin may approach two inches.

An example of a graphics printer which prints with wide end margins is a thermal printer having model number 4693D made by Tektronix, Inc. of Beaverton, Oreg. This printer leaves a wide trailing edge margin because an initial idler roller must be spaced from the printing zone of the platen. The leading margin is wide because the paper is captured by a clamp disposed on a large take-up drum also spaced from the printing zone. The resulting end margins are about 1.5 inches each.

Another limitation is the curved platen itself, which causes the head-to-media spacing to be different for different nozzles in the array. Head-to-media variations inherently cause ink drop placement errors and also accentuate drop placement errors caused by variations in the drop velocity. These errors make the image quality unacceptable for high resolution graphics.

Another limitation of typewriter-style systems is that certain types of ink jet printing require the paper to be heated when the ink drop is applied. While it is possible to produce a heated rotating platen, it is a difficult problem and in a relatively high speed machine the paper may not be in contact with the platen long enough to reach the required temperature.

Some typewriter-style systems allow printing to begin before the paper reaches the idler rollers by using an additional set of rollers located below the print head to advance the paper past the print head and into the main set of idler rollers. Thus at the beginning of the copy, the lower rollers drive the paper. For the majority of the copy both sets of rollers drive the paper. At the end of the copy the upper idler rollers drive the paper.

This approach poses two problems for ink jet graphics printers. First, at the beginning of the copy the paper is pushed into position in front of the head and left there in an uncontrolled state. This is not a problem for a typical dot matrix head because the head wires will naturally push the paper against the plater if required. In an ink jet machine the critical head-to-media spacing has been lost, causing drop placement errors as well as temperature variations because of loss of contact with the platen. Second, a "hand off" has been introduced when the paper passes from one set of rollers to another, causing a momentary loss of position in the amount of paper advance. The resulting variation between lines of text is not discernable to the human eye, but the same variation in a continuous graphic image is unacceptable.

SUMMARY OF THE INVENTION

The present invention overcomes these disadvantages of the known prior art. In particular, it provides a print medium sheet feed system which allows printing with substantially reduced margins at the sheet ends, regardless of the size of the print head. It also eliminates any hand off from one paper drive to another. That is, it provides continuous control of the paper with a single driver during printing.

This is particularly provided by the invention in the form of an apparatus for conveying a print medium sheet having a leading edge along a travel path through a printing zone where an image is printed on the sheet. The apparatus comprises means for conveying the sheet leading edge through the printing zone; means for grasping the sheet after it travels through the printing zone; and means for transporting the grasping means away from the printing zone, and thereby transporting a grasped print medium sheet through the printing zone.

In another aspect of the invention a flat imaging area which may be placed parallel to a flat print head face is provided. This in particular is provided by an apparatus as mentioned above, but comprising means for conveying the sheet leading edge through the printing zone, and means for supporting the sheet in the printing zone in a planar orientation. In a preferred embodiment of the application, a drum in the form of a plurality of disks is provided with a base plate mounted on one edge of the disk so that it has a face along the tangent of the disk peripheral surfaces. An engaging plate is shiftable between a position spaced from the base plate so that a sheet will fit therebetween. The engaging plate is then shiftable to a second position in which the engaging plate is urged toward the base plate sufficiently for supporting and grasping a print medium sheet therebetween. The drum then rotates pulling the sheet past the print head. Thus, the sheet is held by a single mechanism prior to commencement of printing and is controlled throughout the printing process by the single drive mechanism.

Further, the sheet is maintained in a flat orientation, parallel to a print head, by providing a flat platen on the opposite side of the sheet from the print head. This platen preferably has grooves for receiving the rotating disks so that the platen face is disposed along a tangent to the peripheral surface of the disk. A nip region is formed upstream from the printing zone by placing a biased spring plate against an extended surface of the platen so that force is required to pull a sheet through the printing zone. Thus, tension is established across the printing zone holding the paper against a flat surface. Alternatively, the flat platen may be removed and the paper simply pulled under tension through the printing zone with the sheet being supporting along a flat surface defined by the disk peripheral surfaces and the edge of the plate forming the nip region.

The disks are preferably large enough in diameter so that a single sheet does not cover the entire circumference of the disk during printing, thereby allowing the clamp attached to the disks not to come in contact with the platen at the end of a printing cycle. The use of a drum having an enlarged diameter is thus required by this embodiment. The use of disks to form the drum provides a low inertial mass supporting surface which can be precisely stamped out and cut.

Thus the present invention in its various features, provides a device which accomplishes the intended purposes, while providing a simple design having few parts. It is thereby relatively inexpensive to produce. These and other features and advantages of the invention will become apparent from a reading of the following detailed description of the preferred embodiment and a review of the associated drawings.

DETAILED DESCRIPTION OF THE PREFERRED EMBODIMENT

Figure 1:
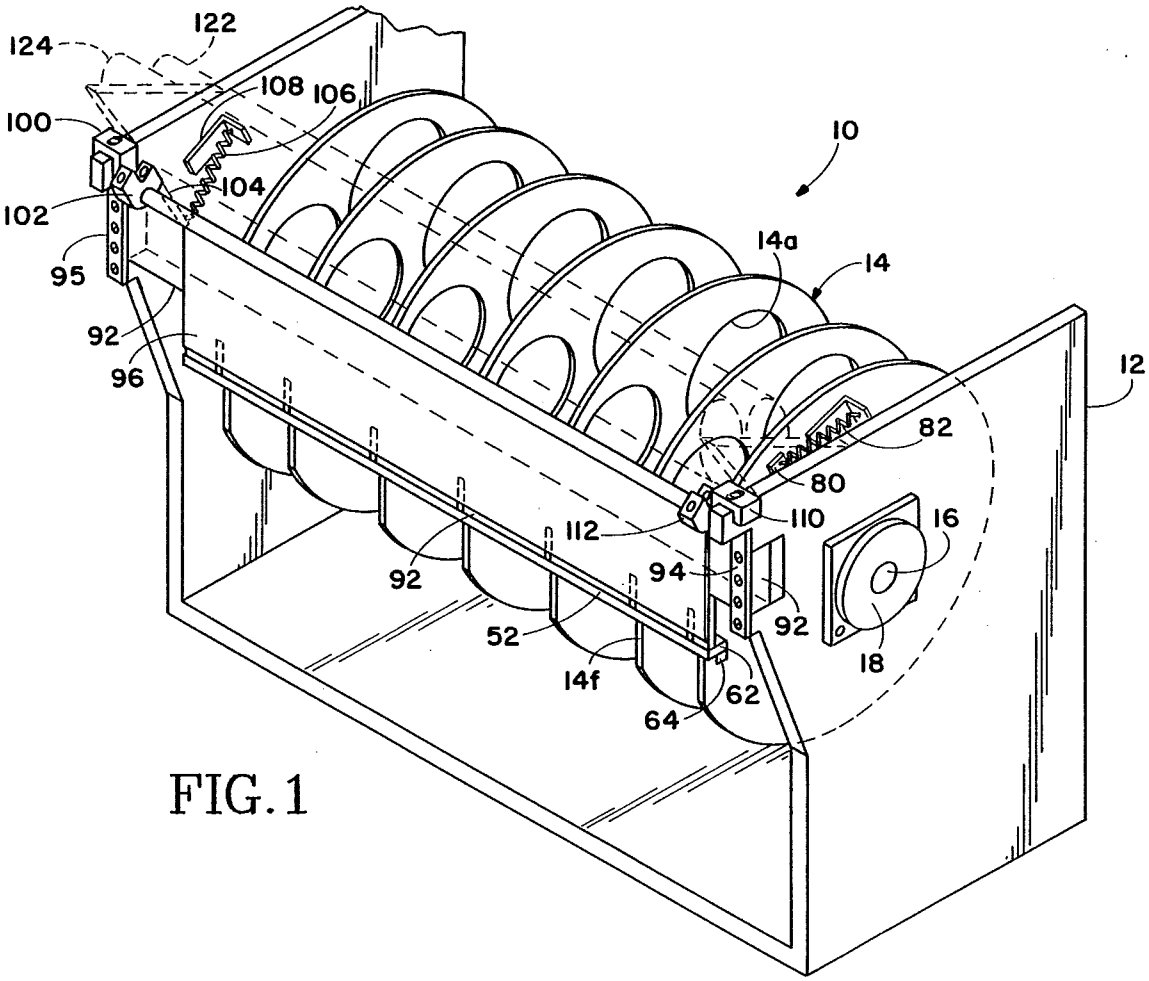
FIG. 1 is an isometric view of a printer sheet feed system made according to the present invention.

Referring initially to FIGS. 1–5, a preferred embodiment of a printer sheet feed system 10 made according to the present invention is shown. This system includes a frame 12 which supports the apparatus forming the system. A plurality of circular disks 14 preferably have a diameter of a sufficient size to support a desired size of paper. For instance, disks having a diameter of 6.4 inches will accommodate a sheet 18 inches long. Voids in the disks, such as opening **14*a*, decrease their mass. The disks also have an opening 14*b* located at the center of the disks for passage of an axle 16 therethrough. The ends of the axle extend through openings in the frame and are received in end bearing mountings 18 and 20**.

Disks 14 are rotated about their longitudinal axis as defined by axle 16 by a drive assembly 22. Assembly 22 includes a stepper motor 24 mounted to frame 12. A drive shaft 26 extends through the frame toward disks 14, as shown. Mounted on drive shaft 26 is a pulley 28 which drives a timing belt 30. An intermediate axle 32 is mounted rotatably to frame 12. Axle 32 carries a larger diameter timing pulley 34 in line with pulley 28 and is driven by timing belt 30. Attached to the distal end of axle 32 is a second reduced-diameter timing pulley 36 which drives a second timing belt 38. This belt drives a drive pulley 40 mounted to axle 16. Drive assembly 22 can thus be seen to advance in incremental steps the rotation of disks 14 about their longitudinal axis.

Between pulley 40 and the adjacent disk 14 is a stainless steel spacer 42 having a diameter substantially larger than that of axle 16. At the opposite end of axle 16 is another stainless steel spacer 44 positioned between the frame and the first associated disk. In between each of the other disks are plastic spacers, such as spacers 46 at each end and intermediate spacers 48. The stainless steel end spacers are used to provide rigid support for the disk assembly. The intermediate spacers provide moderately rigid spacing while minimizing the amount of mass which must be rotated.

It can thus be seen that the entire disk assembly provides in essence a cylindrical "drum" having an exterior surface, also referred to as a support surface **14*c*** defined by the outer periphery of each disk. This drum has a substantially reduced mass as compared to a cylinder having solid exterior shell. Further, it has the advantage of being manufacturable with precision in that the circular disks can be stamped out with very little variance in the radius of the disks. This uniformity is critical to high resolution printing. Achieving the same uniformity with a solid surface drum is more costly and difficult to do.

A notch **14*d* is formed in the outer edge of each disk 14. Each notch includes a radially extending edge 14*e* and a partial chord section 14*f* which extends perpendicularly to radial edge 14*e*. Notch 14*d* also has a closed T-shaped opening 14*g* having shoulders 14*h* which will be used as described shortly. The overall notch 14*d* provides for the fastening of a paper clamping or grasping assembly 50. This is shown most clearly in FIGS. 4 and 5**.

Clamping assembly 50 includes paper engaging plates 52 and 53 disposed between or next to the disks, as shown. Plates 53 are at the ends of the clamp assembly and plates 52 are in between. The structure and function of engaging plates 52 and 53 are substantially identical except for the outline of each plate, as viewed in FIG. 2. Therefore, the following description specifically describes engaging plate 52, with the understanding that the description is equally applicable to engaging plates 53 on the ends of the clamp assembly.

Each engaging plate has an end **52*a* parallel with the tangent of disk 14. This plate end is shiftable between a first position, shown in dashed lines in FIG. 5, in which it is spaced sufficiently away from the disk tangent to allow a print medium sheet 54 to be freely received therein against face 52*b*. Engaging plate 52 is generally L-shaped with a long (as viewed in FIG. 5) end 52*c* extending radially inwardly along the edges of the disks to a position beyond the edge of notch 14*d*. A printing zone, shown generally at 56 is defined by the position of an ink jet array 60 of a printing head 58, shown in dashed lines in FIG. 5 and in solid lines in FIG. 4. The "footprint" in effect of the jets during printing at a single head location is also represented by dashed lines in FIG. 3** with a representation of an array formed of two transverse lines of ink jets.

The distance between the jet array and platen face **92*c* is 0.040 inches. The thickness of engaging plate end 52*a*** is preferably 0.012 inches, leaving 0.028 inches for sheet thickness and clearance.

A base plate 62 extends along the length of printing zone 56 coextensively with the engaging plates. Plate 62 has an end face **62*a* which faces an inner face 52*b* of engaging plate 52. These faces are the contact surfaces for a sheet of paper 54** which is held on the disks for imaging, as will be described.

The engaging plate ends 52*c* adjacent the radially extending surface of base plate 62 are sandwiched in between the base plate and a backing plate 64 which is mounted to base plate 62 by a nut and bolt assembly 66. The nut is T-shaped, as viewed from the side in FIGS. 4 and 5, with the arms of the T secured on disk shoulders 14*h*. Each backing plate 64 has a channel 64*a* which slidingly receives the portion of the engaging plate extending radially inwardly along the disks. The edge of each end 52*c* has a small hole 52*d* to which are secured two first springs 68. The opposite end of each spring 68 is connected similarly to an actuating bar 70. This bar extends through openings 14*i* in the disks, which openings are larger than the actuating bar, allowing it movement in line with end 52*c* of the engaging plate. Extending between plate 52 and actuating bar 70 is an extension bar 72 which is securely fastened to actuating bar 70 by nut and bolt assemblies 74, as shown.

Figure 5:
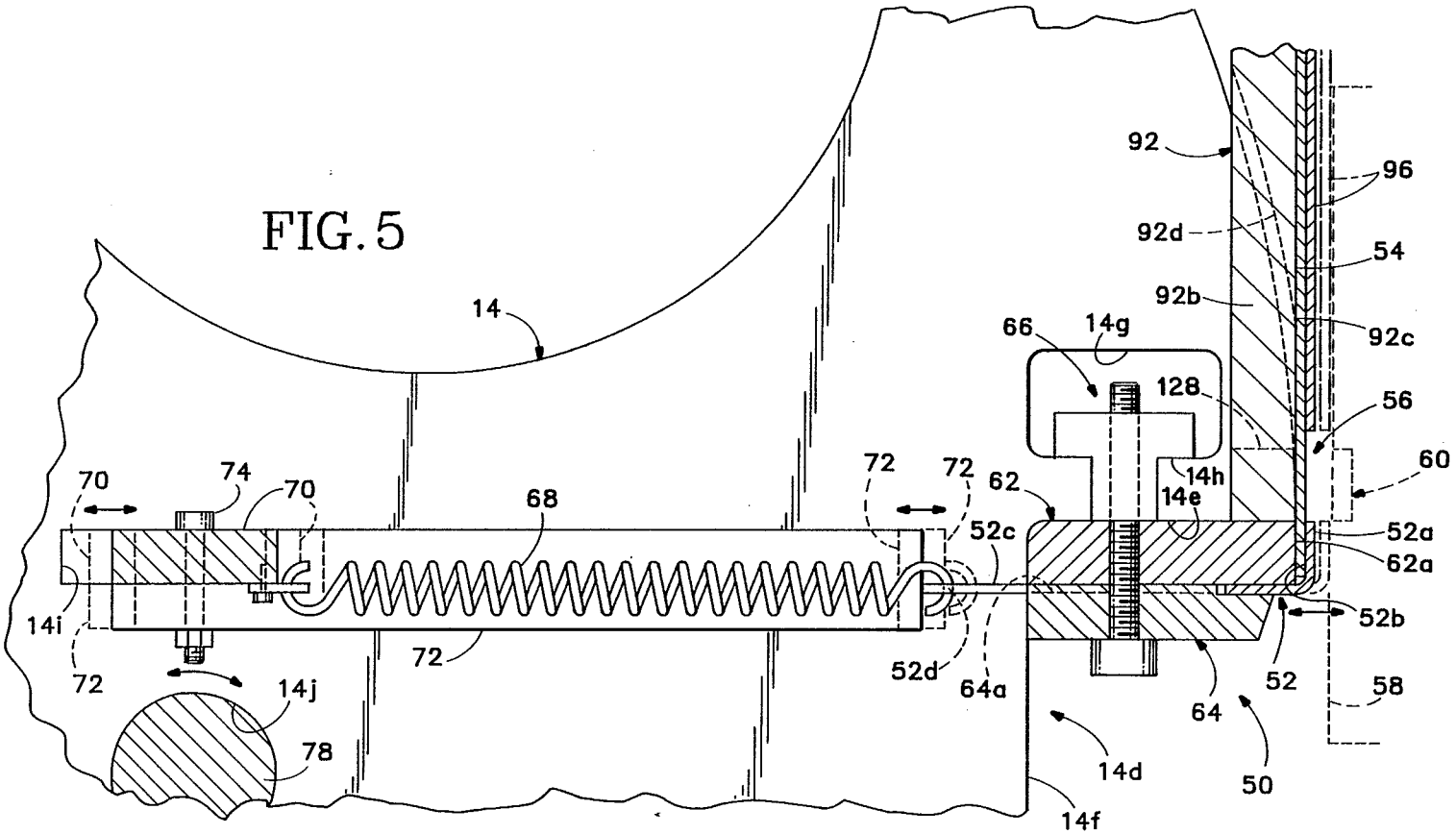
FIG. 5 is a further enlarged cross section of a portion of the system of FIG. 1 taken along line 5—5 of FIG. 2.

As particularly shown in FIG. 5, actuating bar 70 and extension bar 72 are shiftable to what is referred to as a third position, identified by the phantom lines on the left of the solid vertical lines. In this position, bar 72 is pulled away from end 52*c* of engaging plate 52. With the extension bar pulled away from the end of the engaging plate, the force of springs 68 extending between the engaging plates and the actuating bar are under tension so that they apply a force to engaging plate 52. Thus, the force of springs 68 secures ends 52*a* of the engaging plates against face 62*a* of the base plate. If a piece of print medium sheet 54 is positioned therebetween, it is securely held.

When actuating bar 70 is in the position shown by the solid lines, with extension bar 72 against the engaging bars, a position referred to as a fourth position, allows the assembly comprised of actuating bar 70, extension bar 72 and engaging plate 52 to move to the right as a unit. This position, shown in the phantom lines in FIG. 5, is referred to as a fifth position wherein the space between engaging plate face 52*b* and base plate end face 62*a* are spaced apart to allow the insertion of the leading edge of a sheet.

The positioning of the assembly of bars 70 and 72, and plate 52 is controlled by an actuating rod 78 which extends through further apertures 14*j* in each disk. This rod is rotatable relative to the disks and serves as an axle for a lever arm 80 secured to the right end of the axle, as viewed in FIG. 2. This lever arm includes a slot 80*a* which receives a pin 70*a* extending from the distal end of actuating bar 70, as particularly shown in FIG. 2. Thus as the lever arm is moved back and forth as shown by the phantom lines in FIG. 4, actuating bar 70 is also moved back and forth between positions three and five described previously.

Springs 68, of which there are two for each engaging plate or a total of twelve, provide a total force of six pounds, when extension bar 72 is pulled away from the end of engaging plates 52 and 53. This has been found to be sufficient force to securely grasp the leading edge of a sheet and hold it during printing.

At the distal end of lever arm 80 is a biasing spring 82 which pulls the lever arm in a manner biasing, through actuating and extension bars 70 and 72, engaging plate end face 52*b* toward end face 62*a* of base plate 62. However, the force on spring 82 is not sufficient to overcome the six pound force provided by springs 68. In this position, there is therefore insufficient force to securely hold a sheet within the clamp provided by the engaging and base plates.

Actual engaging force is provided by a solenoid 84 which is of sufficient strength to overcome springs 68. Solenoid 84 is attached to the side of the disk 14 adjacent to end bearing mounting 18. The solenoid activates the lever arm by a throw bar 86 which engages lever arm 80 by a pin 88 passing through a second slit 80*b*. When the energy is removed from solenoid 84 the lever arm returns to the intermediate position shown by the solid lines in FIGS. 4 and 5.

Figure 4:
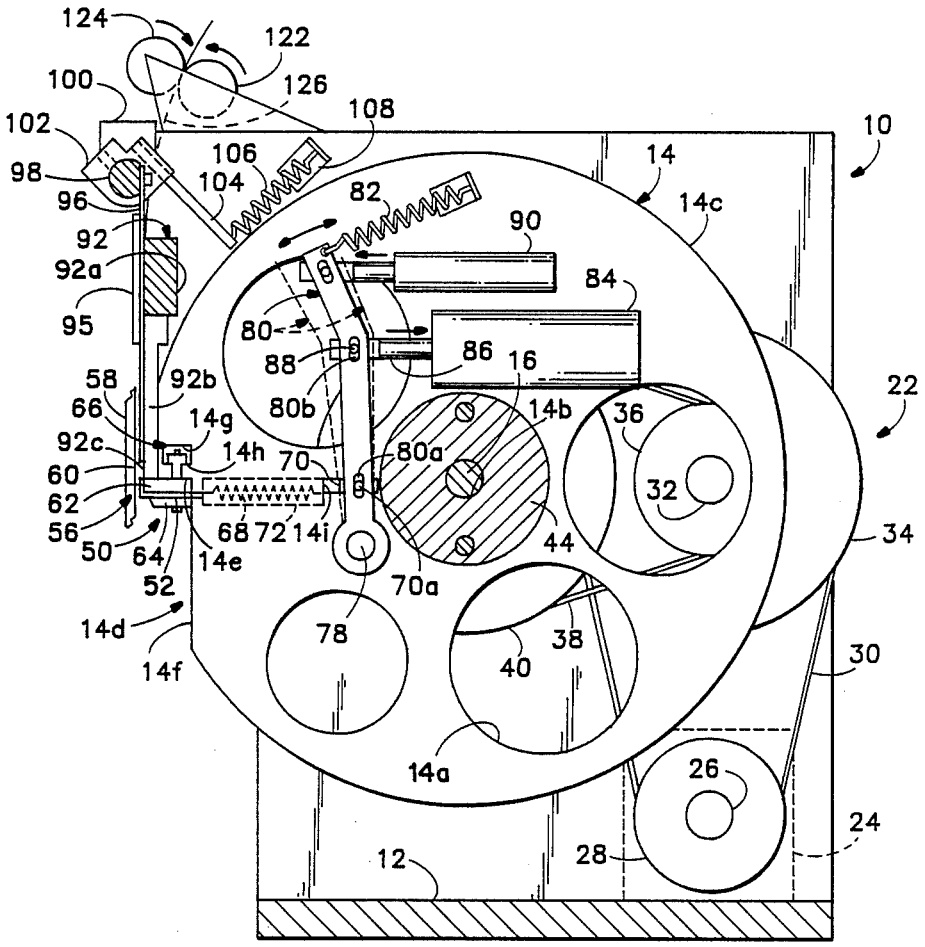
FIG. 4 is an enlarged cross section taken along line 4—4 of FIG. 2.

In order to release a sheet of paper by opening the clamp provided by the engaging and base plates, a second, reduced size solenoid 90 is similarly attached to disk 14 and connected to the distal end of lever arm 80, as shown in FIG. 4. Solenoid 90 only has to be strong enough to overcome the force provided by bias spring 82. This is a much smaller force. If it was not for the second bias spring 82 being attached to lever arm 80, the engaging set of bias springs 68 would have to be structured so that they securely hold the clamp in a clamping position. Thus, solenoid 90 would then have to be sufficiently large and have a long enough throw to disengage engaging plate 52 and base plate 62. Thus, clamping assembly 50 provides a simplified mechanism because the assembly of engaging plate, actuating bar and extension bar, held together by springs 68 moves as a unit when paper is disengaged and the clamp is opened to receive a new sheet.

The present invention also provides means for maintaining a print medium sheet in the printing zone in a planar orientation. This assures that the distance between the sheet and the various ink jets in the ink jet array will have the same distance of travel, thereby assuring reproducibility in alignment of the pixels printed on the sheet to form the desired image.

In the embodiment of FIGS. 1–5 this is provided by a flat platen 92 which extends the length of the assembly of engaging plates 52 and 53, and thereby printing zone 56. Platen 92 has an enlarged section 92*a* which extends into channels in frame 12 where it is securely mounted by mounting brackets 94 and 95, particularly shown in FIG. 3. As viewed from the side as shown in FIG. 4, platen 92 reduces to a narrow end 92*b* having a face 92*c* directed toward print head 58, which lies along a tangent to disks 14. A groove 92*d* is formed in end 92*b* for each disk to allow the surface of the disks to align with face 92*c*.

In the position shown in FIGS. 4 and 5, the printing system is ready to begin printing. In this position, the top side of base plate 62 is flush against the end of section 92*b* of the platen and provides a flat surface along which sheet 54 travels during imaging.

Figure 2:
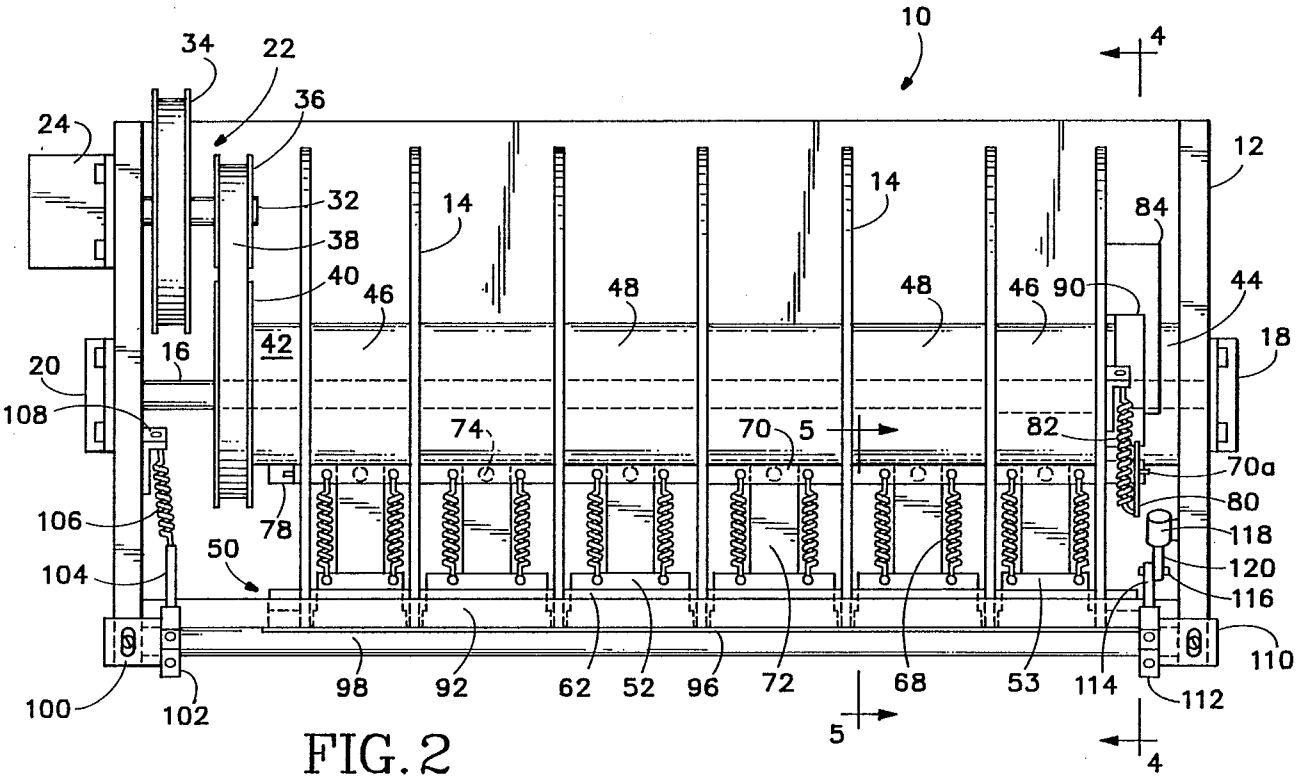
FIG. 2 is top view of the system of FIG. 1.
Figure 3:
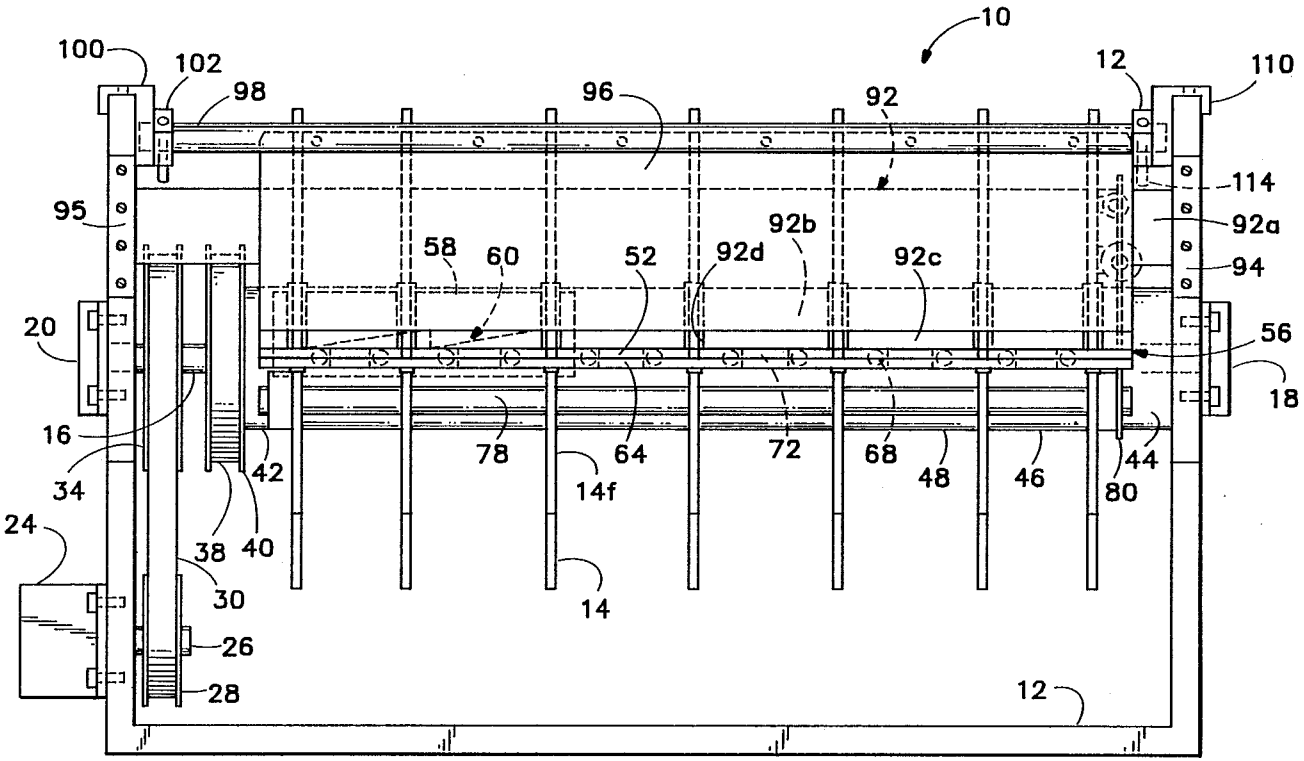
FIG. 3 is a front view of the system of FIG. 1 and also a view from the bottom of FIG. 2.

The paper is further secured by a nip region formed in the upstream portion of the sheet travel path, defined by the location of sheet 54 in FIG. 5. This nip region is formed in part by the extension away from the printing zone of platen thin section 92*b*, and associated face 92*c*. The paper is secured against face 92*c* by a spring plate 96 which is secured to frame 12 for rotation about a securing rod 98 mounted for rotation along its longitudinal axis. As shown in FIGS. 2 and 4, spring plate 96 is secured to the rear face of rod 98. On the left end of rod 98 adjacent a mounting bracket 100 which secures rod 98 to the frame, is a further mounting bracket 102 which is secured directly to rod 98. Bracket 102 has extending from it a lever arm 104, the distal end of which is attached to a biasing spring 106, the opposite end of which is connected to a mounting bracket 108 attached to frame 12, as shown. Spring 106 thus urges plate 96 against platen 92 by the rotation of rod 98.

At the opposite end of rod 98 is a mounting bracket 110 for securing the opposite end of the rod to frame 12 and a mounting bracket 112 which is secured to rod 98. An additional lever arm 114 the same as lever arm 104 has attached to its distal end through a pin 116 a solenoid 118 having throw arm 120 to which is connected pin 116. Solenoid 118 is fixedly attached to frame 12. The action of throw arm 120 is to rotate rod 98 against the force of biasing spring 106 so that spring plate 96 is moved into a position spaced from face **92*c* of the platen, as shown by the dashed dot phantom line of FIG. 5. In this position, a sheet 54** may freely pass between the platen and the spring plate.

Finally, a pair of feed rollers 122 and 124 is shown in phantom lines in FIG. 1 and in solid lines in FIG. 4. These roller are mounted for rotation, as represented by the arrows, to frame 12. These provide a nip region for inserting a sheet 54 into system 10 along the sheet travel path 126 shown by the dashed line in FIG. 4. These rollers are driven by an appropriate drive motor (not shown) in order to insert a sheet 54 between the spring plate and platen for receipt in the clamp formed by the engaging and base plates, described previously. Once the paper is inserted in this position, rollers 122 and 124 no longer drive the sheet so that control of the sheet is entirely by the rotation of disks 14 while being grasped by clamp assembly 50.

Referring now to FIGS. 6A–6D, operation of system 10 is illustrated. For ease of illustration, only the outline of the disks, the end of the platen, engaging plate 52, and spring plate 96 are shown. These illustrations are upside down compared to the structure of FIGS. 1–5, but the apparatus is otherwise structured and functions the same. As just mentioned, when a sheet 54 is loaded into system 10, spring plate 96 and engaging plate 52 are moved outwardly so that the sheet can pass freely past the spring plate and up against the engaging plate. The engaging plate and spring plate are then respectively brought against base plate 62 and platen 92, as represented by the arrows in FIG. 6B to allow printing to begin. It can be seen, in this position, that the only margin of the sheet which cannot be printed is that which is within engaging plate end **52*a***. If a text image which is in black and white is being printed, then the remainder of the sheet can have an image formed on it. However, if printing is used wherein a plurality of jets are required to print on each line, such as when colors are required, then all of the exposed lines may not be printable. Even so, the margin can be kept to a total of less than approximately 0.2 inches. This is a very small margin compared to the possible 1½ to 2 inch margin that would otherwise be required.

Figure 6A:
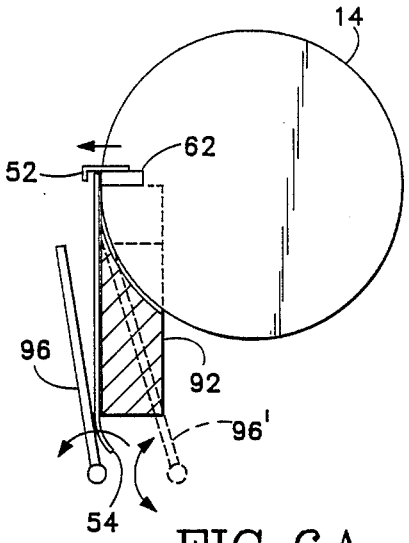
FIGS. 6A–6D are simplified side views illustrating operation of the system of FIG. 1.
Figure 6B:
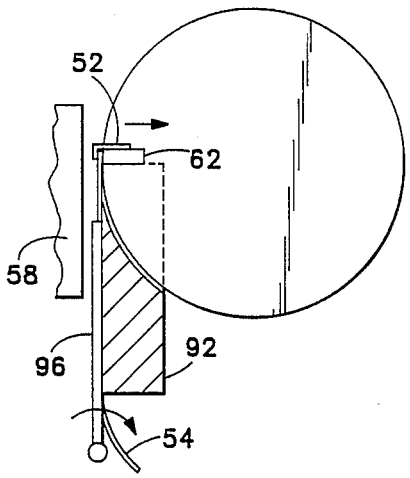
Figure 6C:
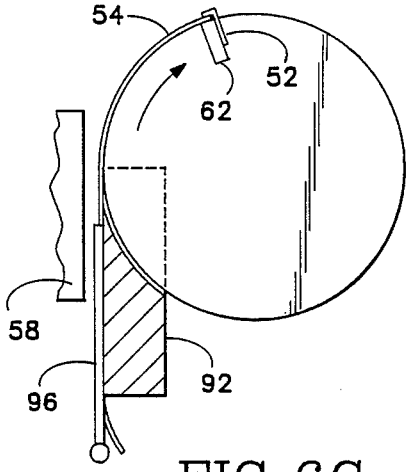
Figure 6D:
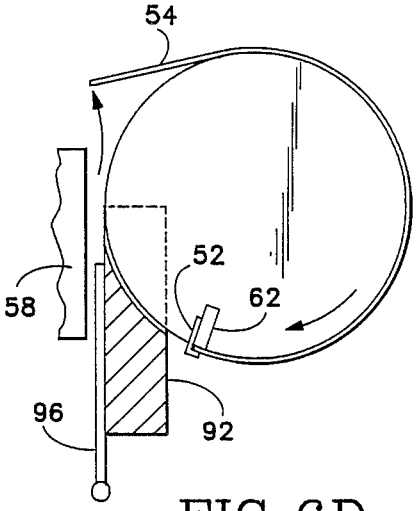

FIG. 6C shows rotation of disks 14 and clamping assembly 50 during imaging. The disks are incrementally advanced as the print head slides back and forth along the printing zone to provide the imaging. After the end of the sheet leaves spring plate 96, the sheet end is no longer controlled, and therefore printing cannot be accurately performed. There also is thus a very small margin at the tail end of the sheet which is not printable. As shown in FIG. 6D, the clamp formed by engaging plate 52 and base plate 62 has traveled around on disk 14 so that it comes close to the back side of platen 92. However, the disks have a sufficient diameter, and therefore circumference, for the full sheet to be supported by the disk support surface without the clamp contacting the platen.

A couple of alternative embodiments of the preferred embodiment shown in FIGS. 1–6 are illustrated in FIGS. 5 and 6. In FIG. 5, the dashed line 128 illustrates an embodiment wherein the platen 92 has a shortened end **92*b* which comes up to but does not extend along printing zone 56. In this embodiment, paper 54 is still held in a planar orientation through the printing zone by the tension placed on the paper by the combination of the nip region provided by platen 92 (no longer functioning as a platen) and spring plate 96 along with the clamp provided by engaging plate 52 and base plate 62**. It is thus not necessary that the platen extend into the printing zone for a nonimpact printer. However, it may be preferred that the paper be heated for curing of the ink when it is deposited on the paper. The platen may be structured to provide heating of the sheet as it travels through the printing zone. However, other forms of heating elements could also be positioned behind the sheet in the printing zone. For instance, a thin flexible heater, such as a type which consists of a resistor element etched into a Kapton film, may be used.

A third form of the embodiment is illustrated by the dashed lines for plate 96' shown in FIG. 6A. In this embodiment platen 92 does not exist and plate 96' presses against the surface of disk 14. The spring plate would also be movable so that it could be moved from contact with the paper traveling on the plate when the paper has passed through the printing zone. Thus, the same nip region providing tension on the paper would be provided in the embodiment shown in dashed lines in FIG. 6A. In this embodiment, a flat platen is not provided and the paper is not held in a planar orientation through the printing zone. However, it has been found that with disks having a sufficiently large diameter, and with an ink jet print head having a sufficiently narrow printing zone, even though there is some curvature of the paper passing through the printing zone, variations in the placement of ink pixels on an image are not readily discernable.

Reference is now made to FIGS. 7A–7G which illustrate a fourth embodiment of the present invention. A paper feed system 130 includes a small diameter drum 132 or series of disks like disk 14, constructed for rotation about a longitudinal axis 134, like the rotation of disks 14, previously described. A lever arm, such as lever arm 136, is disposed at each end of drum 132. These arms support a clamp-actuating arm 138 which is pivotable at an end **138*a* where it attaches to lever arm 136, as shown. Extending between distal ends 138*b* is a clamp or engaging plate 140 disposed selectively adjacent to the surface of drum 132. This clamp plate extends the width of drum 132. A biasing spring 142 extends between the base of lever arm 136 and distal end 138*b*. This spring urges the distal end, and therefore plate 140 toward the surface of the drum. A solenoid 144, similar to the solenoids disclosed with reference to system 10, is connected also between lever arm 136 and actuating arm 138, as shown. It is activatable to move the distal end 138*b* away from the drum surface, as shown by the arrow in FIG. 7A. In this position, there is sufficient space between plate 140** and the drum surface to freely receive the leading edge of a sheet on which an image is to be printed.

A printing zone 146 exists below the position of the distal end of actuating arm 138 shown in FIG. 7A. Spaced away from the printing zone is a set of rollers, such as roller 148. These rollers, are similar to rollers 124 or 122 in that they are fixed in position at the orientation shown and are biased by a spring 147 against the drum surface so that a paper passing between the rollers and the drum is maintained in contact with the drum. Therefore, as the drum moves, a sheet will move along with it.

Disposed in the path of a sheet upstream from printing zone 146 is an assembly providing a nip region 149. This nip region is formed, as was the case with the first embodiment, of a spring plate 150 and a restraining plate 152. The spring plate, as with the prior embodiments, is shiftable between a position in which it is adjacent the distal end of restraining plate 152 adjacent the printing zone, and a second position in which it is sufficiently spaced from the restraining plate to allow a sheet to pass freely therethrough.

Figure 7A:
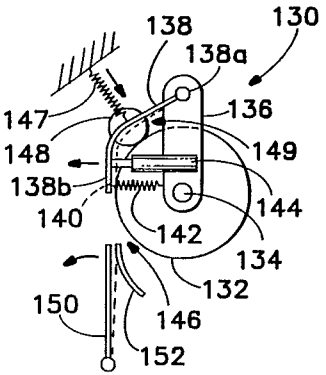
FIGS. 7A–7G are simplified side views illustrating structure and operation of a second embodiment.

As shown in FIG. 7A, the apparatus of system 130 is positioned for receipt of a sheet prior to printing.

Figure 7B:
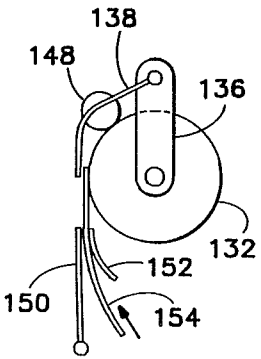
Figure 7C:
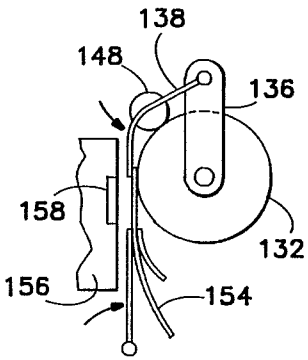

FIG. 7B shows a sheet 154 inserted through nip region 149 and into the clamp formed by distal end **138*b* and the surface of drum 132. FIG. 7C shows the spring plate biased against the restraining plate to form nip region 149 and distal end 138*b* of the actuating arm is clamping the leading edge of sheet 154 against the surface of drum 132. A printing head 156 having an ink jet array 158 is positioned for printing in printing zone 146. It will be noted that this embodiment provides a planar orientation of sheet 154 in the printing zone in the same manner that it is provided in the second embodiment of system 10** wherein no platen is provided but the paper sheet is held in tension across the printing zone.

Figure 7D:
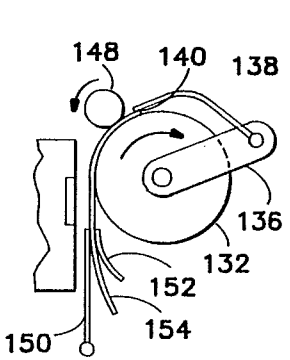

As drum 132 is rotated as shown by the arrow in FIG. 7D, lever arm 136 is locked in rotational position to drum 132 so that plate 140 is engaged for bringing the paper along the drum surface away from the printing zone. In the position shown in FIG. 7D the clamp has carried the paper past rollers 148 so that now the rollers also engage the sheet against the drum.

Figure 7E:
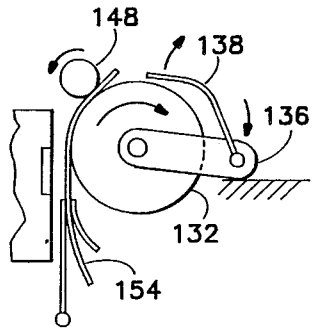

With the roller thus engaged, the clamp is no longer necessary, and may be released, as shown in FIG. 7E wherein distal end **138*b* is released, and lever arm 136 is concurrently released from drum 132. As shown in this figure, the lever arm rests against a brace by gravitational pull with the actuating arm distal end 138*b*** disengaged from the drum surface and the sheet.

Figure 7F:
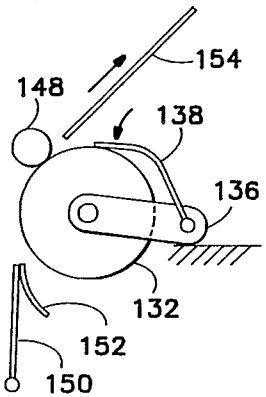
Figure 7G:
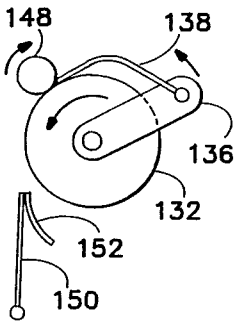

As the drum continues rotating, rollers 148 continue holding the paper against it so that the paper is drawn through the printing zone and through nip region 149 until printing is completed. In FIG. 7F, the removal of the sheet from drum 132 is illustrated since it has passed through the nip region provided by rollers 148 and drum 132. After the paper is removed, actuating arm distal end **138*b* is brought in engagement against drum 132** and the drum counterotated, as shown in FIG. 7G, until the actuating arm distal end is brought into the initial position shown in FIG. 7A, at which point the cycle is repeated for the next sheet of paper.

In this embodiment of the invention, the drum size can be as small as 1.4 inches in diameter while allowing a sheet of any length to be imaged. The disk size associated with system 10 requires a drum size of 5.5 inch diameter in order to accommodate an 11 inch by 17 inch sheet of paper. This is accomplished by mounting the clamp independently of the roller or drum so that the drum rotation, and therefore the paper motion, is not limited by the clamp position. In addition, the conventional round platen is replaced by maintaining a sheet flat in the printing area.

It should be noted that while the sheet is initially held against the drum by the clamp and finally by the idler rollers 148, this does not constitute a handing off from one paper drive to another. In both cases drum 132 itself is the only driving force for the sheet, so no variations are introduced into the amount that the paper is indexed. As was the case with system 10, a flat surface platen could also be provided in order to provide the flat surface. Thus, except for the diameter of drum 132 and the structure of lever arm 136 and actuating arm 138 and rollers 148, this design is structured substantially the same as that shown for system 10.

It will be seen that the present invention provides a simplified paper feed system for conveying a print medium sheet through a printing zone for printing by a printing head which provides preferably a flat surface for printing by an ink jet array which is planar and parallel with the paper passing through the printing zone. Further, means are provided for grasping the paper and conveying it through the printing zone using a single grasping apparatus, in the embodiment of system 10, during the entire printing operation, and using a combination of grasping mechanisms which are based on a single drive unit in the embodiment of system 130. By tensioning the sheet as it goes through the printing zone, it may be supported against a flat surface platen, or just held in a planar configuration by the tension which exists on the sheet.

It will therefore be appreciated that variations may be made in the present invention, such as by varying the size and the shape of the platen if one is used at all, and the formation of a tensioning mechanism for tensioning a sheet as well as the size of the drum or rotating disks providing a support surface for a sheet conveyed through a printing zone. Therefore, although the invention has been described with reference to the foregoing preferred embodiments, it will appreciated by those skilled in the art that variations in the structure and detail may be made without varying from the spirit and scope of the invention as described in the claims.

We claim:

1. Apparatus for conveying a print medium sheet having a leading edge along a travel path through a printing zone where an image is printed on the sheet and having means for conveying the sheet leading edge to the printing zone, said apparatus being characterized by:

means for grasping the sheet leading edge after it travels to the printing zone comprising a base plate and an engaging plate, each having a face adjacent to which a sheet traveling to the printing zone travels, which faces face each other, said engaging plate being movable relative to said base plate between a first position in which the faces are spaced from each other for receiving the leading edge of the sheet, and a second position in which said faces are sufficiently close to grasp a sheet positioned therebetween, first biasing means for urging said engaging plate toward the second position, and an actuating plate positionable in a third position spaced from said engaging plate and a fourth position contacting said engaging plate, and second biasing means for urging said actuating plate toward the fourth position; and means for transporting said grasping means away from the printing zone, and thereby transporting a grasped print medium sheet through the printing zone.

2. An apparatus according to claim 1 wherein said engaging plate is urged toward the second position when said actuating plate is in the third position.

3. An apparatus according to claim 2 wherein said second biasing means is stronger than said first biasing means whereby said actuator plate is being held in the fourth position while said engaging plate is urged toward the second position.

4. An apparatus according to claim 3 wherein said actuating plate is movable toward a fifth position while in the fourth position, whereby said engaging plate is moved by said actuating plate from the second position toward the first position, said grasping means further comprising first actuating means for moving said actuating plate from the third position toward the fifth position, thereby overcoming said first biasing means.

5. An apparatus according to claim 4 wherein said grasping means further comprises second activating means for moving said actuating plate toward the third position and overcoming said second biasing means, whereby said second biasing means urges said engaging plate toward the second position.

6. Apparatus for conveying a print medium sheet having a leading edge along a travel path through a printing zone where an image is printed on the sheet, said apparatus comprising:

means for conveying the sheet leading edge to the printing zone;

means for grasping the sheet after it travels to the printing zone;

means for transporting said grasping means away from the printing zone, and thereby transporting a grasped print medium sheet through the printing zone; and means for supporting the sheet in the printing zone in a planar orientation comprising means defining an open space extending the full width of the printing zone through which the sheet passes, such that the full width of the sheet is not in contact with a support surface in the printing zone, and means for tensioning the portion of the sheet traveling through the zone.

7. Apparatus for conveying a print medium sheet having a leading edge along a travel path through a printing zone where an image is printed on the sheet, said apparatus comprising:

means for conveying the sheet leading edge through the printing zone; and means for supporting the sheet in the printing zone in a planar orientation comprising means defining an open space extending the full width of the printing zone through which the sheet passes, such that the full width of the sheet is not in contact with a support surface in the printing zone, and means for tensioning the portion of the sheet traveling through the zone.

* * * * *